US006538679B2

(12) United States Patent
Hiyoshi

(10) Patent No.: US 6,538,679 B2
(45) Date of Patent: Mar. 25, 2003

(54) OPTICAL WRITING DEVICE AND IMAGE FORMING APPARATUS PROPERLY OPERABLE UNDER THERMAL EXPANSION

(75) Inventor: Takayuki Hiyoshi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/983,304

(22) Filed: Oct. 24, 2001

(65) Prior Publication Data

US 2002/0051049 A1 May 2, 2002

(30) Foreign Application Priority Data

Oct. 31, 2000 (JP) ..... 2000-331845

(51) Int. Cl.[7] ..... B41J 2/44
(52) U.S. Cl. ..... 347/138; 347/245
(58) Field of Search ..... 347/130, 138, 347/152, 242, 245, 238, 263

(56) References Cited

FOREIGN PATENT DOCUMENTS

| | | |
|---|---|---|
| JP | 6-344595 A | * 12/1994 |
| JP | 7-61035 | 3/1995 |
| JP | 10-86438 | 4/1998 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

An optical writing device includes an integral structure of a plurality of light emission device array units securely connected together, the units including respective lines of light emission devices, the lines being formed into a longer line of light emission devices on the integral structure, a position fixing member, and a connection mechanism that fixes the integral unit to the position fixing member only at a single connection point such that displacement of the integral unit relative to the position fixing member in a direction of the longer line is prevented only at the single connection point but unrestricted at any other points.

16 Claims, 12 Drawing Sheets

OPTICAL WRITING DEVICE AND IMAGE FORMING APPARATUS PROPERLY OPERABLE UNDER THERMAL EXPANSION

BACKGROUND OF THE INVENTION

1. Field of the Invention

The present invention relates to an optical writing device using a plurality of light emission device array units, and relates to an image forming apparatus such as a digital copier, a printer, and a facsimile apparatus.

2. Description of the Related Art

Japanese Patent Laid-open Application No. 10-86438 and Japanese Patent Laid-open Application No. 7-61035 disclose an optical writing device that is provided with a plurality of light emission device array units, each of which has light emission devices arranged thereon along a line, and is arranged one after another in a staggered manner along a line so as to connect all the lines of the light emission devices.

Japanese Patent Laid-open Application No. 10-86438 teaches an LED head set comprised of a plurality of LED heads arranged in an axial direction of a photosensitive body. This configuration makes it possible to expose the whole extent of a photosensitive area extending in the axial direction of the photosensitive body by utilizing each one of the LED heads.

In this type of conventional art, each light emission device array unit is implemented on a print circuit board having a relatively short length such as a length of an A3-size sheet. A plurality of such light emission device array units are arranged along a line so as to form a longer composite line of light emission devices, thereby forming an optical writing device having a relatively long length. Use of such an optical writing device for illuminating the photosensitive body to form a latent image has the following advantages (a) and (b).

(a) It is possible to write a wide image such as the width of an A0 size sheet. When a wide image having the width of an A0 size is to be printed, an optical writing device may be used that has a single light emission device array unit the size of 1 m or so that is longer than the width of A0 size. Such a light emission device array unit having a length of 1 m would be very expensive if it is to be manufactured such that light emission devices are arranged at a 400 dpi (i.e., dot pitches equal to 63.5 micrometer), for example. Such price increase is brought about by difficulties in maintaining sufficient precision over the whole extent of the light emission device array unit in addition to the needs for larger facilities and a drop of the yield rate. The optical writing device comprised of a plurality of units can obviate this problem. (b) If an optical writing device is implemented by using a single light emission device array unit having the length of 1 m, the entire optical writing device needs to be replaced in an event that even one light emission device for one dot fails. In the case of the optical writing device comprised of a plurality of units, only a light emission device array unit that includes the failed light emission device should be replaced, rather than replacing the whole device.

The configuration of the conventional art has the advantages (a) and (b) as described above. In the optical writing device having a plurality of light emission device array units arranged in a staggered manner along the line of light emission devices, however, alignment of dots at the joint point between adjacent units becomes an issue to be addressed, and so does the warping of each light emission device array unit.

A dot pitch at the 400 dpi is 63.5 micrometer. With this dot pitch, an error of the dot pitch should be smaller than 5 micrometer in order to avoid black or white stripes appearing on the reproduced image. Further, a focal length of a light emission device array. unit is generally much shorter than that of a laser writing apparatus, so that the distance from the photosensitive body needs to be accurate within a tolerance range of 0.1 mm or less.

When a plurality of light emission device array units are connected by use of simple support members or the like in a straightforward manner as in the conventional art, the temperature of the light emission device array units will increase due to a change in ambient temperature, heat generation by the light emission device array units themselves, or a temperature increase within the housing of the image forming apparatus caused by heat generated by other components of the apparatus. As a result, each light emission device array unit exhibits thermal expansion.

If the two ends of each light emission device array unit are fixedly mounted on a support member, the unit is warped by the difference of temperature and thermal expansion factors between the unit and the support member, so that there is a risk of losing the accuracy of a focal distance. In order to avoid such warping, each unit may be fixed only at a single point in the direction of a light emission device line, so that portions not fixed to the support member can slide relative to the support member in the direction of the light emission device line. In such a configuration, however, a gap between adjacent light emission device array units will change, resulting in the dot pitch being changed at the joint point. This may cause black or white lines to appear in the reproduced image.

Accordingly, there is a need for a wide-size and inexpensive optical writing device that can avoid the warping of light emission device array units caused by thermal expansion thereof and undesirable lines appearing on reproduced images, and, also, there is a need for an image forming apparatus using such a device.

SUMMARY OF THE INVENTION

It is a general object of the present invention to provide an optical writing device and an image forming apparatus that substantially obviate one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by an optical writing device and an image forming apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides an optical writing device, including an integral structure of a plurality of light emission device array units securely connected together, the units including respective lines of light emission devices, the lines being formed into a longer line of light emission devices on the integral structure, a position fixing member, and a connection mechanism that fixes the integral unit to the position fixing member only at a single connection point such that displacement of the integral unit relative to the position fixing member in a direction of the longer line is prevented only at the single connection point but unrestricted at any other points.

Further, the present invention provides an apparatus for forming an image, including a photosensitive body, an optical writing device which forms a latent image on the photosensitive body by scanning light on the photosensitive body, and a developing unit which converts the latent image into a visible image, wherein the optical writing device includes an integral structure of a plurality of light emission device array units securely connected together, the units including respective lines of light emission devices, the lines being formed into a longer line of light emission devices on the integral structure, a position fixing member, and a connection mechanism that fixes the integral unit to the position fixing member only at a single connection point such that displacement of the integral unit relative to the position fixing member in a direction of the longer line is prevented only at the single connection point but unrestricted at any other points.

DESCRIPTION OF THE PREFERRED EMBODIMENTS

In the following, embodiments of the present invention will be described with reference to the accompanying drawings. A description of the first embodiment will be given first.

Figure 1:
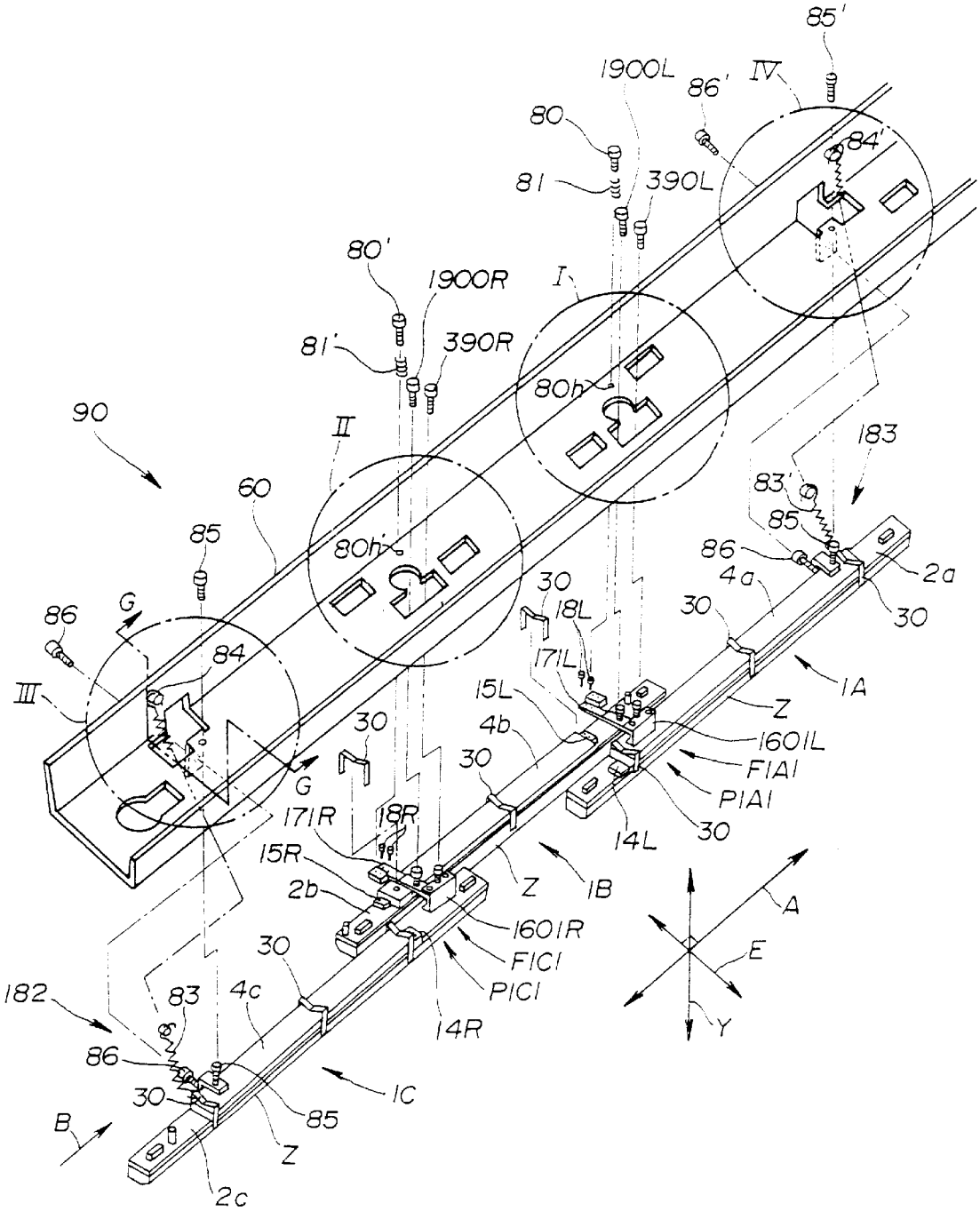
FIG. 1 is a drawing showing a plurality of light emission device array units attached to a support member.

FIG. 1 is a drawing showing a plurality of light emission device array units attached to a support member.

In FIG. 1, light emission device array units 1A, 1B, and 1C are provided side by side to extend in a direction A in which light emission devices (not shown) are arranged. Focus adjustment mechanisms P1C1 and P1A1 displaces the light emission device array units 1A and 1C relative to the light emission device array unit 1B in a focal point adjustment direction, which corresponds to a direction Y along the height of the light emission device array units. Sub-scan adjustment mechanisms FlC1 and FlAl adjust the swinging movement of the light emission device array units 1A and 1C relative to the light emission device array unit 1B, so that light emitted from the light emission device array units 1A and 1C is adjusted in a sub-scan direction E to come closer to or go away from the light emitted from the light emission device array unit 1B. With these adjustment mechanisms, the optical writing device of the present invention can adjust the focus of the light emission device array units and the position of writing in the sub-scan direction.

In this example, the focus adjustment mechanism P1C1 (P1A1) and the sub-scan adjustment mechanism F1C1 (F1A1) are provided as an integral unit. Further, a screw mechanism utilizing the principle of a lever makes it possible to attain focus adjustment and the adjustment of a writing position in the sub-scan direction. In the following, an example will be described.

In FIG. 1 through FIG. 8, the light emission device array units 1A, 1B, and 1C include circuit boards 2*a*, 2*b*, and 2*c*, lens cases Z, and lens arrays 12*a*, 12*b*, and 12*c* made of optical convergence material, respectively. Reinforcement members 4*a*, 4*b*, and 4*c* are provided for circuit boards 2*a*, 2*b*, and 2*c*, respectively, although these reinforcement members are omitted in FIG. 2 and FIG. 3 for the sake of clarity of illustration.

The light emission device array units 1A and 1C are situated in a symmetric position relative to the light emission device array unit 1B where the axis of symmetry is a line D—D passing through the axis O of a photosensitive drum 10. Light emitted from each light emission device array unit has an optical axis that is directed to the axis of the photosensitive drum.

Figure 3:
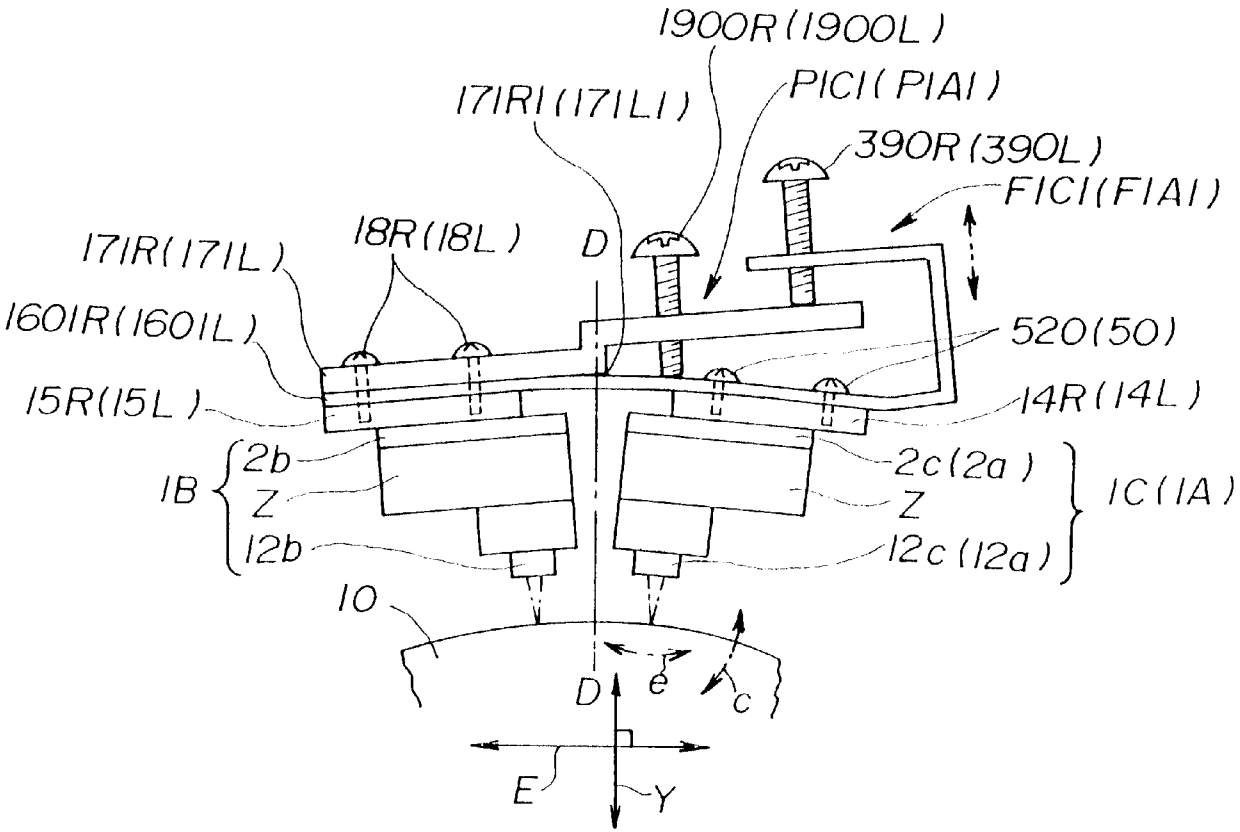
FIG. 3 is a view of the light emission device array units and relevant components that connect the light emission device array units together.
Figure 4:
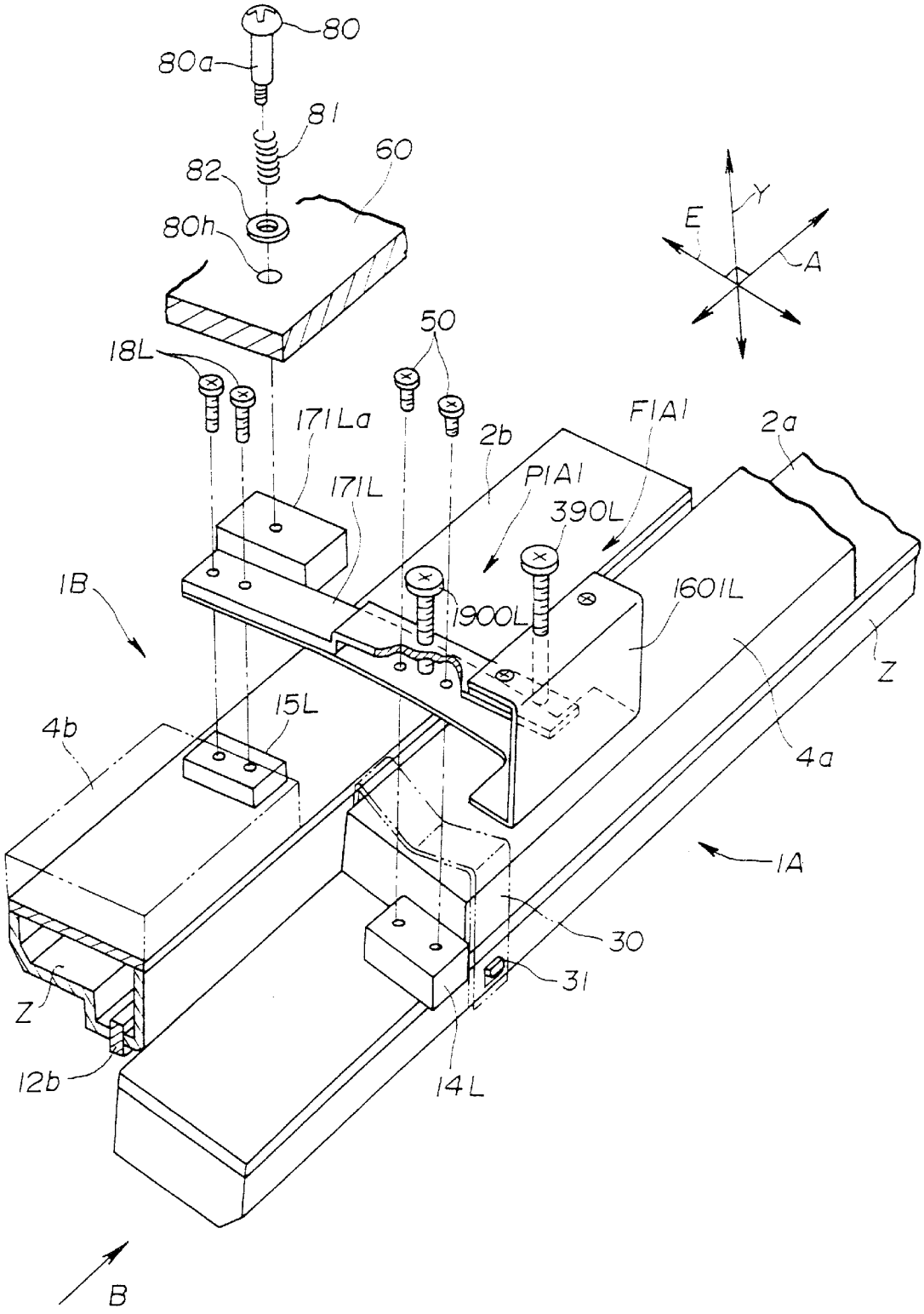
FIG. 4 is an enlarged view of a connection mechanism corresponding to a position I shown in FIG. 1.

In FIG. 3 and FIG. 4, the light emission device array unit 1A is stuck with adhesive to a spacer 14L having a rectangular shape at a position of the circuit board 2*a*. The light emission device array unit 1B is fixed with adhesive to a spacer 15L having a rectangular shape at a position of the circuit board 2*b*. The spacer 14L is fixedly mounted at one end of a connection member 1601L by screws 50. The other end of the connection member 1601L is fixed to the spacer 15L by screws 18L.

Figure 5:
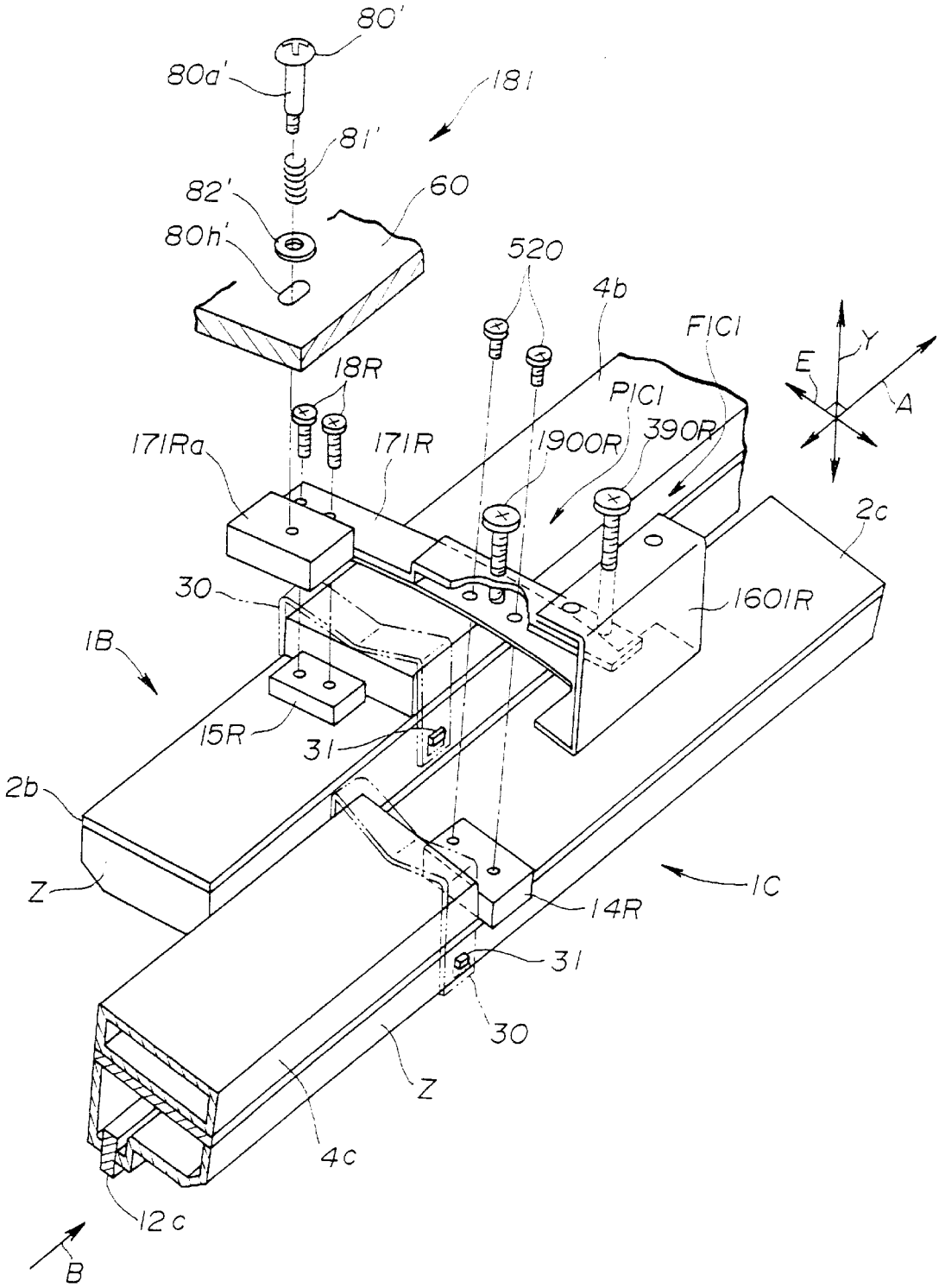
FIG. 5 is an enlarged view of an auxiliary support mechanism corresponding to a position II shown in FIG. 1.

In FIG. 3 and FIG. 5, the light emission device array unit 1C is stuck with adhesive to a spacer 14R having a rectangular shape at a position of the circuit board 2*c*. The light emission device array unit 1B is fixed with adhesive to a spacer 15R having a rectangular shape at a position of the circuit board 2*b*. The spacer 14R is fixedly mounted at one end of a connection member 1601R by screws 520. The other end of the connection member 1601R is fixed to the spacer 15R by screws 1BR.

In FIG. 5, the reinforcement member 4*b* is provided on the circuit board 2*b* that is attached to a lens case Z, and serves to support the circuit board 2*b* and to release the heat of the circuit board 2*b*. A plate spring 30 holds together the circuit board 2*b*, the reinforcement member 4*b*, and the lens case Z such that the circuit board 3*b* is sandwiched between the reinforcement member 4*b* and the lens case Z.

The binding of the circuit board 2*b* and the reinforcement member 4*b* and the binding of the circuit board 2*b* and the reinforcement member Z suffice if gapless contact is achieved. In consideration of this, the plate spring 30 having a M-letter shape has a hole that engages with a pin portion 31 formed on a side surface of the circuit board 2*b*, so that the elasticity of the plate spring 30 makes the circuit board 2*b* sandwiched by the reinforcement member 4*b* and the lens case Z.

In FIG. 3, the focus adjustment mechanism P1C1 includes the connection member 1601R, an adjustment plate 171R, and an adjusting screw 1900R. The connection member 1601R is fixed to the circuit board 2*c* and the circuit board 2*b* via the spacer 14R and the spacer 15R, respectively, where the circuit board 2*c* and the circuit board 2*b* are provided side by side to extend in the direction A, which is the direction of the light emission device line and also the scan direction. The adjustment plate 171R is situated to face the connection member 1601R, and is fixedly connected to the connection member 1601R by the screws 18R where the circuit board 2*b* is also fixedly connected. Further, the adjustment plate 171R is mounted on a position fixing member. The adjusting screw 1900R serves to adjust the gap between the connection member 1601R and the adjustment plate 171R at a position where the circuit board 2*c* is situated.

Figure 2:
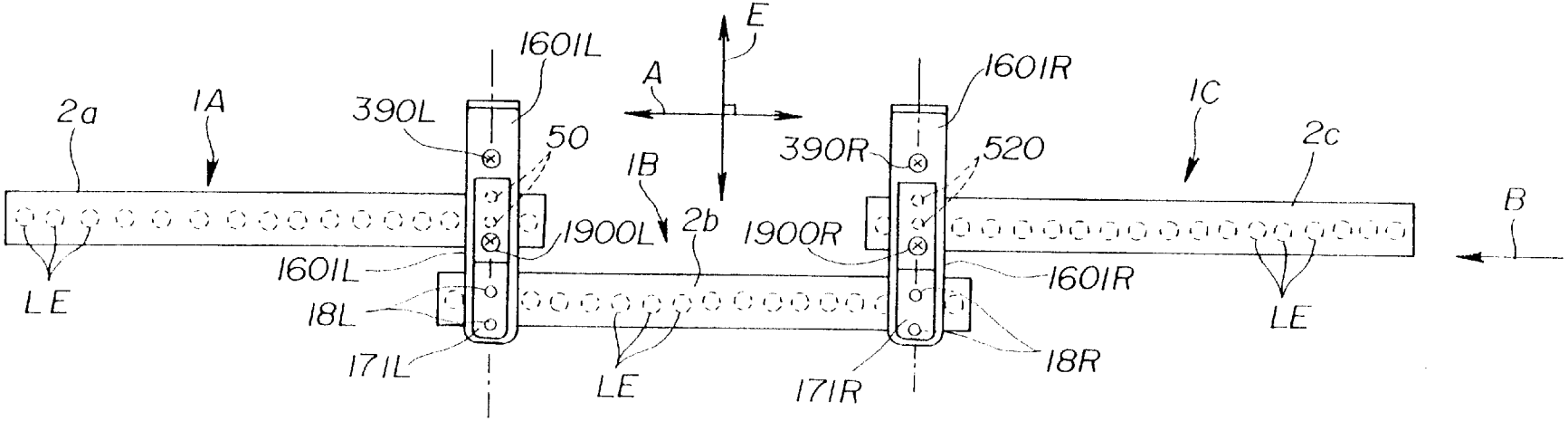
FIG. 2 is a plane view of the light emission device array units connected together.

As shown in FIG. 2, each of the circuit boards 2*a*, 2*b*, and 2*c* has a line of light emission devices LE arranged thereon.

The sub-scan adjustment mechanism F1C1 includes a screw 390R that serves to adjust the gap between the connection member 1601R and the adjustment plate 171R by applying a force to one end of the connection member 1601R on the side where the circuit board 2*c* is situated. A tip of the adjusting screw 1900R serves as a pivot point.

As shown in FIG. 3, the focus adjustment mechanism P1A1 includes the connection member 1601L, an adjustment plate 171L, and an adjusting screw 1900L. The connection member 1601L is fixed to the circuit board 2*a* and the circuit board 2*b* via the spacer 14L and the spacer 15L, respectively, where the circuit board 2*a* and the circuit board 2*b* are provided side by side to extend in the direction A, which is the direction of the light emission device line. The adjustment plate 171L is situated to face the connection member 1601L, and is fixedly connected to the connection member 1601L by the screws 18L where the circuit board 2*b* is also fixedly connected. Further, the adjustment plate 171L is fixedly mounted on the position fixing member (frame 60) by a step screw 80 as shown in FIG. 4. The adjusting screw 1900L serves to adjust the gap between the connection member 1601L and the adjustment plate 171L at a position where the circuit board 2*a* is situated.

The sub-scan adjustment mechanism F1A1 includes a screw 390L that serves to adjust the gap between the connection member 1601L and the adjustment plate 171L by applying a force to one end of the connection member 1601L on the side where the circuit board 2*a* is situated. A tip of the adjusting screw 1900L serves as a pivot point.

The connection member 1601R (1601L) extends further beyond the position where the spacer 14R (14L) is mounted, and forms a U-letter shape to go around and reach a position over the adjustment plate 171R (171L). The screw 390R (390L) is screwed through the connection member 1601R (1601L) at the position over the adjustment plate 171R (171L) and abuts on the upper surface of the adjustment plate 171R (171L). Rotation of the screw 390R (390L) results in the connection member 1601R (1601L) being displaced by pivoting around the tip of the screw 1900R (1900L), thereby adjusting the light emission device array unit 1C (1A) in the sub-scan adjustment direction e.

Further, the rotation of the adjusting screw 1900R (1900L) makes the light emission device array unit 1C (1A) swing around the joint with the adjustment plate 171R (171L) such that the light emission device array unit 1C (1A) is displaced in the focus adjustment direction c. The screw 1900R (1900L) is positioned right above a lens array 12*c* such that the exerted force directly reaches the light emission device array unit 1C (1A). This configuration insures highly accurate focus adjustment. Further, adjustment in the sub-scan direction insures proper focusing.

The screws 390R and 390L and the adjusting screws 1900R and 1900L are situated generally at the same position, so that the screws can be accessed and rotated from the same direction. This makes it possible to simultaneously conduct the focus adjustment of the light emission device array units and the adjustment of a writing position in the sub-scan direction. Adjustment work is thus easily conducted.

The circuit board 2*b*, the lens case Z, and the reinforcement member 4*b* are held together by the plate spring 30 so that they can move relative to each other. As they are movable, a displacement of each member caused by thermal expansion or thermal contraction will not be restricted. With respect to the circuit boards 2*a* and 2*c*, the same configuration as for the circuit board 2*b* is adopted such that a fastening band member is movably attached to make the light emission device array units 1A, 1B, and 1C.

The light emission device array units 1A, 1B, and 1C are connected together by the connection members 1601R and 1601L serving as fastening band members as shown in FIG. 1, FIG. 4, and FIG. 5, and form a single and integral unit together with the sub-scan adjustment mechanisms F1C1 and F1A1 and the focus adjustment mechanisms P1C1 and P1A1. This integral unit is fixedly connected to the frame 60 serving as a position fixing member as well as a common support member. The entirety of this structure inclusive of the frame 60 constitutes an optical writing device 90.

Between the circuit board 2*a* and the circuit board 2*b*, only the spacers 14L and 15L and the connection member 1601L are provided. Between the circuit board 2*b* and the circuit board 2*c*, only the spacers 14R and 15R and the connection member 1601R are provided. These spacers, connection members, and the circuit boards are fixedly connected together, thereby making an integral unit comprised of these circuit boards. The fastening band members other than those connection members are movable relative to the circuit boards in order to avoid an effect of thermal expansion and thermal contraction.

In FIG. 1, the light emission device array unit 1B comprised of the circuit board 2*b*, the lens case Z, the reinforcement member 4*b*, and the plate spring 30 is connected via the connection member 1601L to the light emission device array unit 1A comprised of the circuit board 2*a*, the lens case Z, the reinforcement member 4*a*, and the plate spring 30, forming an integral structure inclusive of the sub-scan adjustment mechanism F1A1 and the focus adjustment mechanism P1A1. The light emission device array unit 1B is further connected via the connection member 1601R to the light emission device array unit 1C comprised of the circuit board 2*c*, the lens case Z, the reinforcement member 4*c*, and the plate spring 30, forming an integral structure inclusive of the sub-scan adjustment mechanism F1C1 and the focus adjustment mechanism P1C1. In this manner, the light emission device array units 1A, 1B, and 1C together form an integral unit.

This integral unit is fixedly connected to the frame 60 serving as a support member (position fixing member) for supporting the integral structure, and this connection is provided only at a single position on the adjustment plate 171L connected to the connection member 1601L (see FIG. 4). This connection prevents a displacement from occurring in the direction A in which the light emission devices are arranged. To be more specific, this connection is provided by a single rod.

Details of this single point connection will be described with reference to FIG. 4. FIG. 4 shows an enlarged view of the portion I shown in FIG. 1.

In FIG. 4, the adjustment plate 171L has a bracket 171La formed as an integral part thereof and having a rectangular shape. The bracket 171La comes in contact with the bottom surface of the frame 60, and is fixed thereto by the step screw 80. The step screw 80 has a rod portion 80*a* inserted into a hole 80*h* formed through the frame 60, and has a tip screw portion screwed into the bracket 171La. A spring 81 and a washer 82 are provided between the screw 80 and the frame 60. The elastic force of the spring 81 fixes the bracket 171La to the frame 60.

Through the entire extent of the light emission device array units 1A, 1B, and 1C, only the step spring 80 provides fixed connection to the frame 60 in the direction A. In addition to this fixed connection, as shown in FIG. 1, the light emission device array units 1A, 1B, and 1C are supported by the frame 60 at three positions shown as II, III, and IV in a movable manner.

In this manner, the light emission device array units 1A, 1B, and 1C, the fastening band members, the sub-scan adjustment mechanisms, the focus adjustment mechanisms, and so on are all connected together to form a single integral structure, which is then fixedly connected to the frame 60 only at a single point so as not to exhibit a displacement in the direction of a light emission device line.

Each light emission device array unit may exhibit a temperature increase and thermal expansion in response to a change in the ambient temperature, heat generated by the light emission device array units themselves, or a temperature increase inside the housing of the image formation device caused by heat generated by other components. Even when such thermal expansion occurs, an integral unit inclusive of the light emission device array units 1A, 1B, and 1C, the connection members 1600R and 1600L, and so on can expand or contract in the direction A while being fixed to the frame 60 at a single point in the direction of a line of light emission devices. Because of this, the light emission device array units are not warped to cause focus failure, and the relative positioning between the light emission device array units is not disturbed. This insures highly accurate optical writing.

In FIG. 5, the adjustment plate 171R has a bracket 171Ra formed as an integral part thereof and having a rectangular shape. The bracket 171Ra comes in contact with the bottom surface of the frame 60, and is fixed thereto by the step screw 80'. The step screw 80' has a rod portion 80*a*' inserted into an elongated hole 80h' formed through the frame 60 and extending in the direction A, and has a tip screw portion screwed into the bracket 171Ra. A spring 81' and a washer 82' are provided between the screw 80' and the frame 60. The elastic force of the spring 81' presses the bracket 171Ra against the frame 60 such that the bracket 171Ra is movable in the direction A. The mechanism that provides support by the frame 60 via the step screw 80' and the elongated hole 80*h*' constitutes a first auxiliary support mechanism 181.

In this manner, the first auxiliary support mechanism 181 is provided, and, further, second and third auxiliary support mechanisms are provided as will be described later. These support mechanisms allows the light emission device array units 1A, 1B, and 1C to be securely supported by the frame 60, thereby stabilizing the accuracy of optical writing.

Namely, the first, second, and third auxiliary support mechanisms provide support that restricts movement in directions (e.g., the sub-scan direction E) other than the direction A, but allows movement in the direction A corresponding to a line in which light emission devices are arranged. Such auxiliary support mechanisms are situated at locations other than the location where the support by the step screw 80 is provided. This makes it possible to securely support the integral structure of the light emission device array units, thereby achieving highly accurate optical writing.

Figure 6:
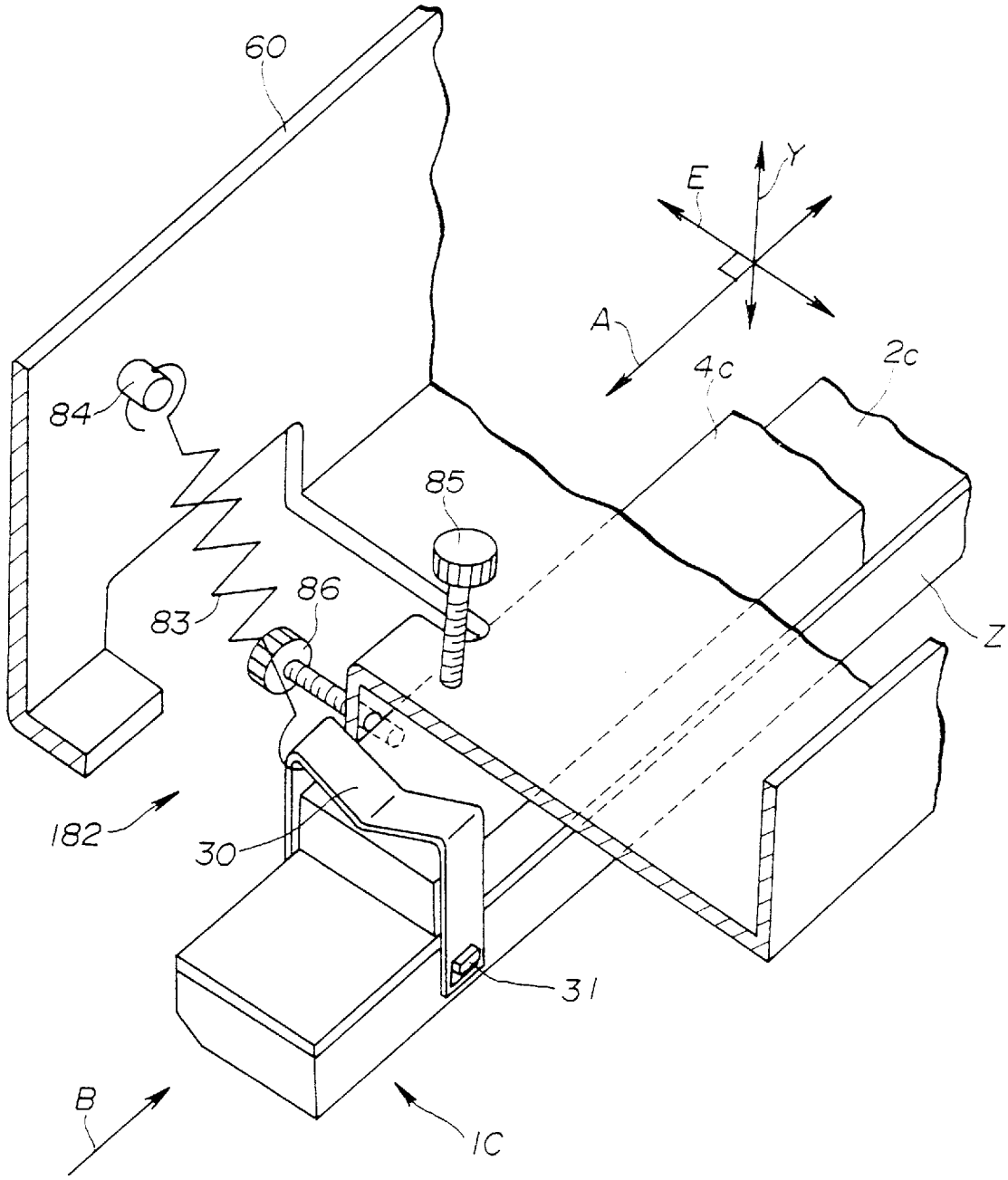
FIG. 6 an enlarged view of an auxiliary support mechanism that is taken along a line G—G shown in FIG. 1.

A second auxiliary support mechanism 182 is provided at a location indicated as III in FIG. 1. FIG. 6 shows an enlarged view of this auxiliary support mechanism that is taken along the line G—G shown in FIG. 1.

In FIG. 6, the plate spring 30 holds together the reinforcement member 4*c* and the circuit board 2*c* at one end of the light emission device array unit 1C extending in the direction A. A spring 83 trying to contract has one end thereof hocked to the plate spring 30, and has the other end thereof hocked to a pin 84 provided on the vertical wall of the frame 60.

In the vicinity of the plate spring 30 to which the spring 83 is hocked, an adjusting screw 85 is screwed through the frame 60 at a portion facing the top surface of the reinforcement member 4*c*, and the tip of the adjusting screw 85 abuts on the top surface of the reinforcement member 4*c*.

In the vicinity of the plate spring 30 to which the spring 83 is hocked, further, a portion of the frame 60 is bent so as to face the side surface of the reinforcement member 4*c*. Through this portion, an adjusting screw 86 is screwed such that a tip thereof abuts on the side surface of the reinforcement member 4*c*.

Figure 7:
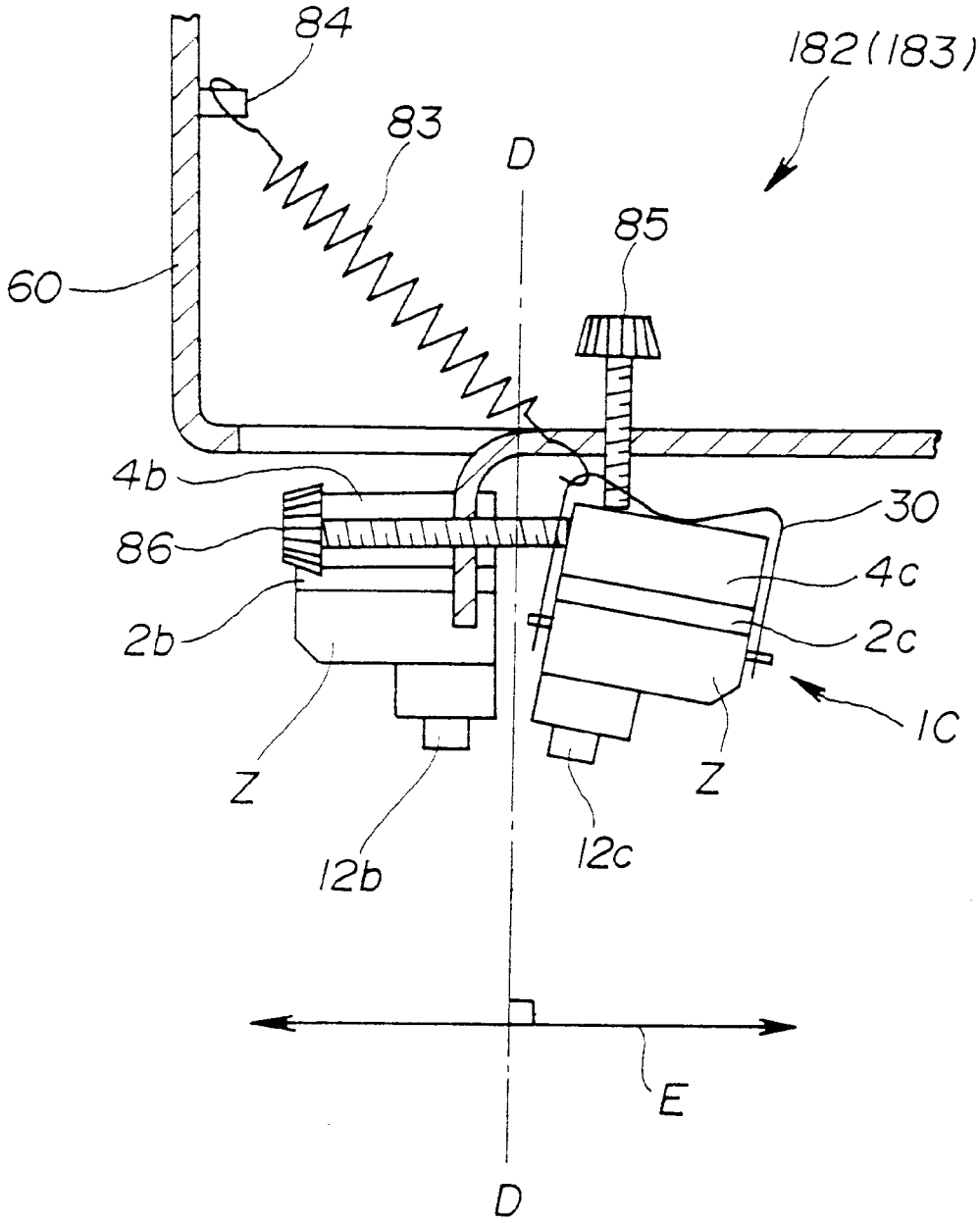
FIG. 7 is a view of the structure of FIG. 5 viewed from a direction shown by an arrow B.

FIG. 7 shows a view of the structure of FIG. 5 viewed from a direction shown by an arrow B. In FIG. 7, a pulling force of the spring 83 is received by the adjusting screws 85 and 86, so that the light emission device array unit 1C is securely supported. Rotation of the adjusting screw 85 achieves the fine adjustment of the pertinent end of the light emission device array unit 1C in the focusing direction, and rotation of the adjusting screw 86 achieves the fine adjustment of the pertinent end of the light emission device array unit 1C in the sub-scan direction E. Since the upper end of the frame 60 is open, it is easy to adjust by the adjusting screw 85. Further, since the portion of the frame 60 corresponding to the adjusting screw 86 is cut and removed, adjustment by the adjusting screw 86 is also easy.

Adjustment by the adjusting screws 85 and 86 is made in response to the adjustment made by the subscan adjustment mechanism F1C1 and the focus adjustment mechanism P1C1. The spring 83 and the adjusting screws 85 and 86 constitute a main part of the second auxiliary support mechanism 182. Since the elastic force of the spring 83 is received at the tip of the adjusting screws 85 and 86 to support the reinforcement member 4*c*, the light emission device array unit 1C is afloat without any restriction being imposed on the movement of the circuit board and the fastening band member in the direction A. When the reinforcement member 4*c* is displaced in the direction A in the case of thermal expansion or thermal contraction, therefore, no stress is applied.

Figure 8:
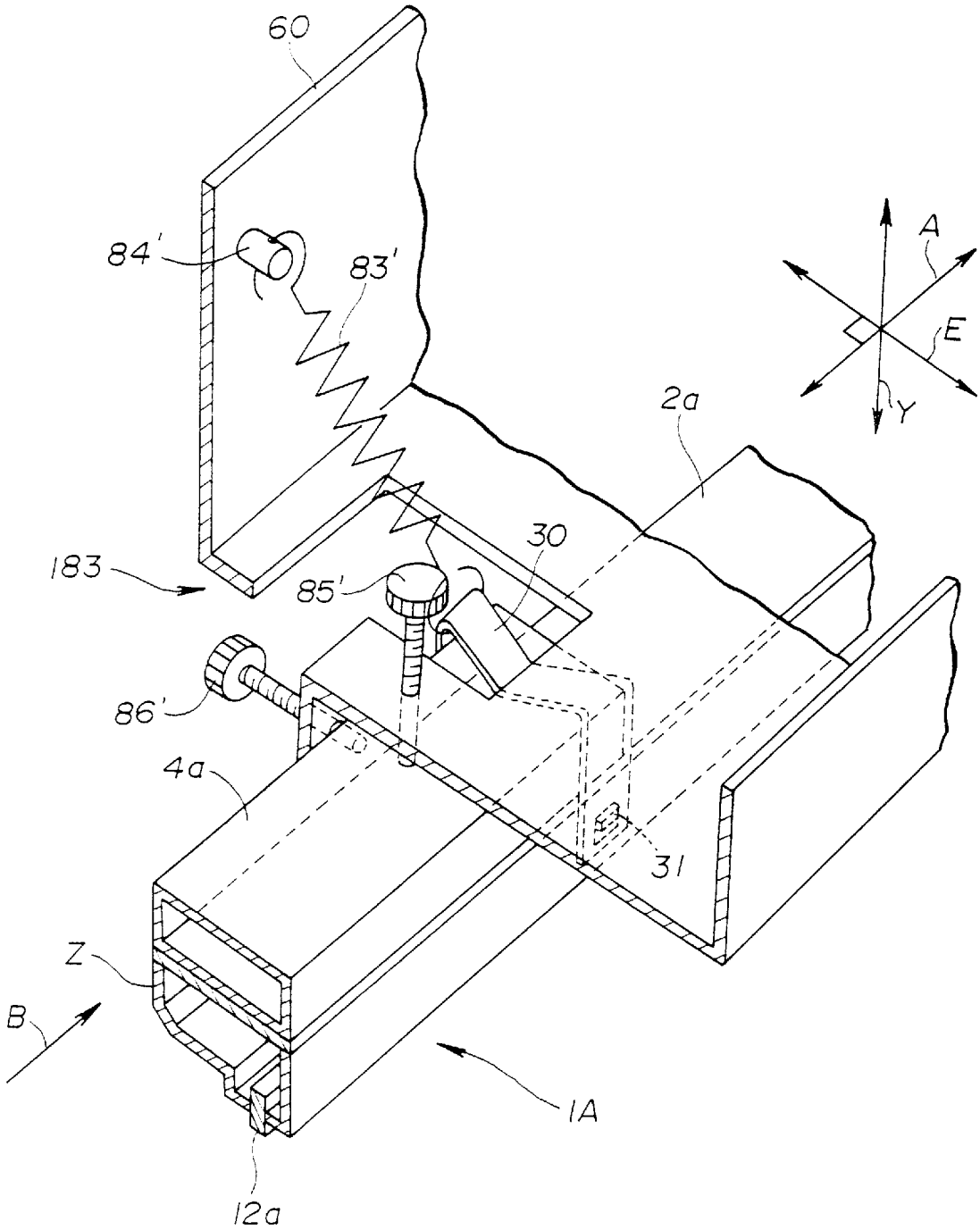
FIG. 8 is an enlarged view of a third auxiliary support mechanism.

A third auxiliary support mechanism 183 is provided at a location indicated as IV in FIG. 1. FIG. 8 shows an enlarged view of the third auxiliary support mechanism 183. In FIG. 8, elements having the same function as those of FIG. 6 are referred to by the same reference numerals with a prime "'" attached thereto.

Each auxiliary support mechanism allows movement in the direction A, and further allows positional adjustment in the sub-scan direction, thereby preventing the accuracy of writing from dropping due to deformation caused by thermal expansion or thermal contraction. Further, the position of writing is adjustable in response to the adjustment made by the sub-scan adjustment mechanism.

In FIG. 8, the plate spring 30 holds together the reinforcement member 4*a* and the circuit board 2*a* at one end of the light emission device array unit 1A extending in the direction A. A spring 83' trying to contract has one end thereof hocked to the plate spring 30, and has the other end thereof hocked to a pin 84' provided on the vertical wall of the frame 60.

In the vicinity of the plate spring 30 to which the spring 83' is hocked, an adjusting screw 85' is screwed through the frame 60 at a portion facing the top surface of the reinforcement member 4*a*, and the tip of the adjusting screw 85' abuts on the top surface of the reinforcement member 4*a*.

In the vicinity of the plate spring 30 to which the spring 83' is hocked, further, a portion of the frame 60 is bent so as to face the side surface of the reinforcement member 4*a*. Through this portion, an adjusting screw 86' is screwed such that a tip thereof abuts on the side surface of the reinforcement member 4*a*.

The relative positioning of the spring 83' and the adjusting screws 85' and 86' is the same as the relative positioning of the spring 83 and the adjusting screws 85 and 86. Adjustment by the adjusting screws 85' and 86' is made in response to the adjustment made by the sub-scan adjustment mechanism F1A1 and the focus adjustment mechanism P1A1.

Since the elastic force of the spring 83' is received at the tip of the adjusting screws 85' and 86' to support the reinforcement member 4*a* as shown in FIG. 8, the light emission device array unit 1A is afloat. When the reinforcement member 4*a* is displaced in the direction A in the case of thermal expansion or thermal contraction, therefore, no stress is applied to the circuit board and the fastening band members.

In this manner, the light emission device array units are attached to the frame 60 serving as a common support member by means of the auxiliary support mechanisms, so that the whole structure of the circuit boards, the fastening band members, the focus adjustment mechanisms, and the sub-scan adjustment mechanisms is securely fastened to the position fixing member, thereby stabilizing the accuracy of optical writing.

In FIG. 1, both ends of the frame 60 are cut off for the sake of simplicity of illustration. In reality, there are extensions of the frame 60 on both sides to go beyond the positions where it is cut. These extensions are connected via focus adjustment mechanisms (not shown) to the two exterior boards of the image forming apparatus situated on the opposite sides.

The optical writing device 90 is connected to the image forming apparatus via the focus adjustment mechanism as described above. Positioning in the focusing direction is made by the focus adjustment mechanisms P1C1 and P1A1.

In this manner, positioning in the focusing direction is made with respect to the optical writing device 90 that is comprised of a plurality of light emission device array units each having a relatively short circuit board and connected together to form a single unit. At the time of positioning in the focusing direction, the frame 60 may be displaced in the sub-scan direction. After the focus adjustment, therefore, the sub-scan adjustment mechanisms F1C1 and F1A1 are used to adjust the light emission device array units 1C and 1A to compensate for such a displacement, so that the lines of optical writing are aligned to that of the light emission device array unit 1B.

In the optical writing device as described in connection with FIG. 1 through FIG. 8, thermal expansion of each light emission device array unit caused by temperature increases causes each writing dot to be displaced. In the example of FIG. 1, an integral structure comprised of the light emission device array units 1A, 1B, and 1C connected together is fixedly mounted on the frame 60 at the position of the step screw 80 where no displacement is possible in the direction A, and this position of the step screw 80 is situated at the left end of the light emission device array unit 1A, i.e., at a position one third of the way through the whole extent. In such a case, a writing dot positioned at a terminal end of the light emission device array unit 1C will show a large displacement as thermal expansion or contraction occurs in the light emission device array units 1A, 1B, and 1C.

A second embodiment of the present invention obviates the problem as described above. To this end, the position where no displacement is possible in the direction A corresponding to the direction of a line of light emission devices is provided at substantially a center of the entire length of the integral unit of the light emission device array units 1A, 1B, and 1C arranged in the direction A. In the illustration of FIG. 1, the position of the step screw 80 may be brought to a center of the whole extent of the integral structure of the light emission device array units 1A, 1B, and 1C by adjusting the overlap of these units.

If the overlap of units is adjusted, the entire length of the light emission device array units cannot be used effectively. In consideration of this, a description will be given below with regard to a case in which the position of no displacement is brought to a general center of the integral structure while utilizing the entire length of the light emission device array units.

Figure 9:
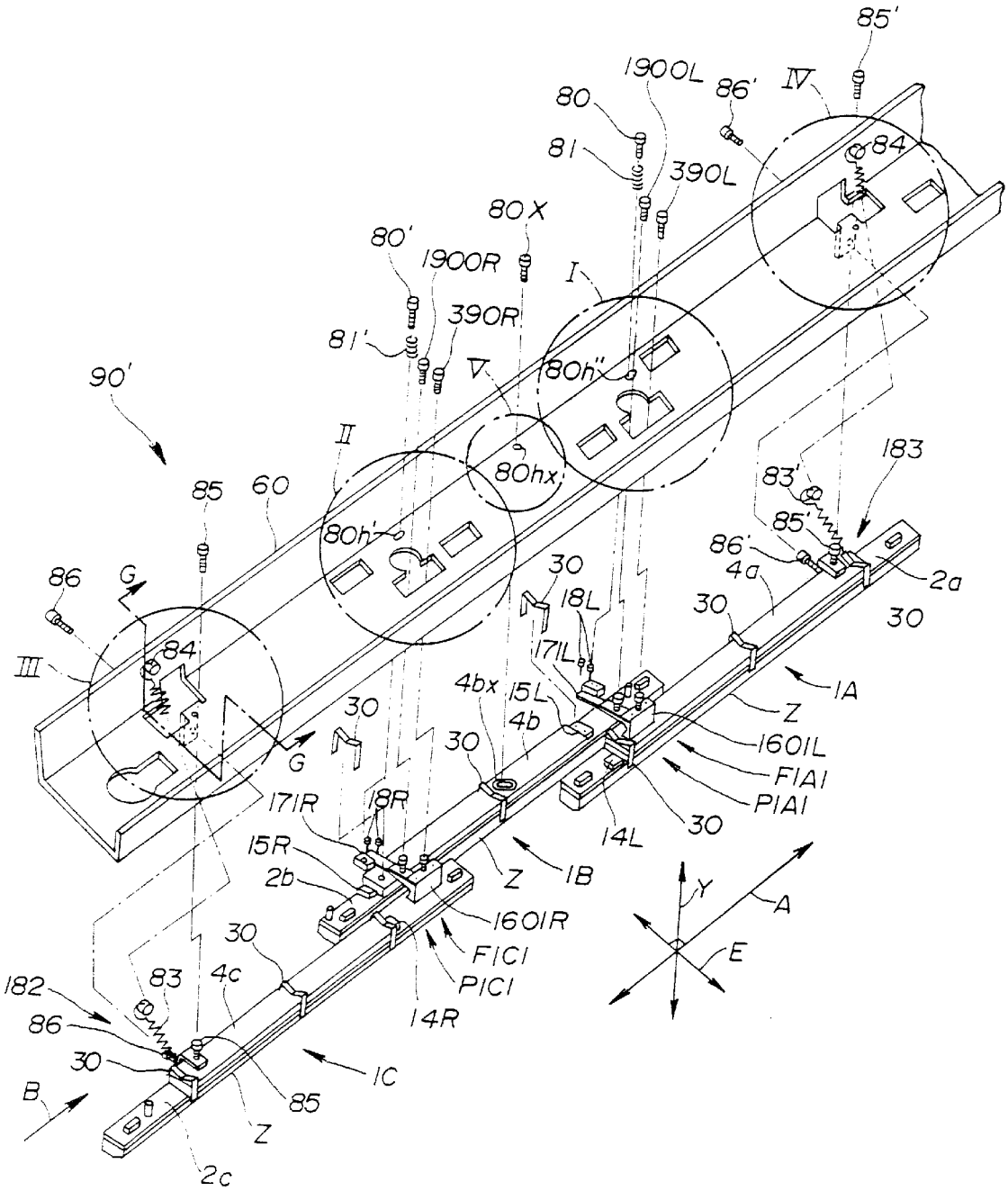
FIG. 9 is a drawing showing a configuration of an optical writing device.

FIG. 9 is a drawing showing a configuration of an optical writing device 90'. FIG. 9 corresponds to FIG. 1, and the optical writing device 90' has many elements identical to those of the optical writing device 90. For the sake of simplicity of illustration in FIG. 9, the same elements as those of FIG. 1 are referred to by the same numerals, and a description thereof will be omitted, except for a case where such a description is necessary.

In FIG. 1, the single fixing point of the optical writing device 90 in the direction A is situated at the position I corresponding to the left end of the light emission device array unit 1A. In the optical writing device 90', an integral device array unit is configured by making the overlap of the light emission device array units 1A, 1B, and 1C as small as possible, and the single fixing point is positioned at the general center of the integral unit.

On the upper surface of the reinforcement member 4*b*, an attaching mound 4*bx* is newly provided at a position corresponding to the general center described above. At a point right above the attaching mound 4*bx*, a hole 80*hx* is made through the frame 60. A screw 80*x* is inserted through the hole 80*hx*, and is screwed into the attaching mound 4*bx*, thereby fixing the integral structure of the light emission device array units 1A, 1B, and 1C at a single point corresponding to the general center in the direction A.

Along with this change, the structure that fixes the bracket 171La by the step screw 80 inserted through the hole 80*h* in the first embodiment is changed to a structure in which the rod portion of the step screw 80 engages in an elongated hole 80*h*″ extending in the direction A in the same manner as the elongated hole 80*h* shown in FIG. 1 and FIG. 5. This configuration allows sliding movement to occur at the time of thermal expansion in the direction A corresponding to the direction of a line of light emission devices.

This embodiment can effectively utilize the entire length of the light emission device array units while obviating the problem that a writing dot at an end of a light emission device array unit exhibits a large displacement in response to thermal expansion or thermal contraction. In this embodiment, the step screw 80 inserted through the elongated hole 80*h*″ serves as an auxiliary support mechanism in addition to the first, second, and third auxiliary support mechanisms 181, 182, and 183, and supports the integral structure of the light emission device array units in a movable fashion.

In the following, a third embodiment of the present invention will be described.

In the first and second embodiments, use of the first, second, and third auxiliary support mechanisms 181, 182, and 183 makes it possible for the light emission device array units 1A and 1C to slide in the direction A in response to thermal expansion or thermal contraction of the array units. The second and third auxiliary support mechanisms 182 and 183 have a configuration that allows pin-shape members such as the adjusting screws 86 and 86' fixed to the frame 60 to abut on plate-shape members such as the reinforcement members 4*a* and 4*c* forming part of the light emission device array units. This abutting of the pin-shape members on the plate-shape members is effected by the elastic force exerted by the springs 83 and 83'. The advancing/retracting of the pin-shape members adjusts the position of the light emission device array units.

In this manner, pin-shape members and plate-shape members are used in combination such that the pin-shape members abut on the plate-shape members. With this provision, the advancing/retracting of the pin-shape members displaces either end of the integral structure of light emission device array units in the sub-scan direction E, thereby adjusting the alignment of the scan line.

In the configurations shown in FIG. 6 and FIG. 8, the tip of the adjusting screws 85 and 86 or the adjusting screws 85' and 86' serving as the pin-shape members abuts on the reinforcement member 4*a* or 4*c* serving as the plate-shape member, and this tip has a sharp pointing end in order to make fine adjustment possible.

The surface of the reinforcement member 4*a* or 4*c* on which this sharp pointing end abuts is a heat releasing plate made of aluminum that serves to release heat. In this configuration, therefore, a sharp pointing end of a screw or the like made of hard material such as iron or stainless is abutting on the surface made of soft material such as aluminum. When thermal expansion of the light emission device array units occurs, the sharp pointing end slides on the plate-shape portion.

This results in the aluminum surface being scraped by the sharp pointing end of the screws. As a consequence, adjusted positioning may be displaced, and friction of sliding movement is increased to prevent smooth sliding movement, giving rise to problems.

In this embodiment, the plate-shape member is a sliding plate made of material substantially as hard as the pin-shape member.

Figure 10:
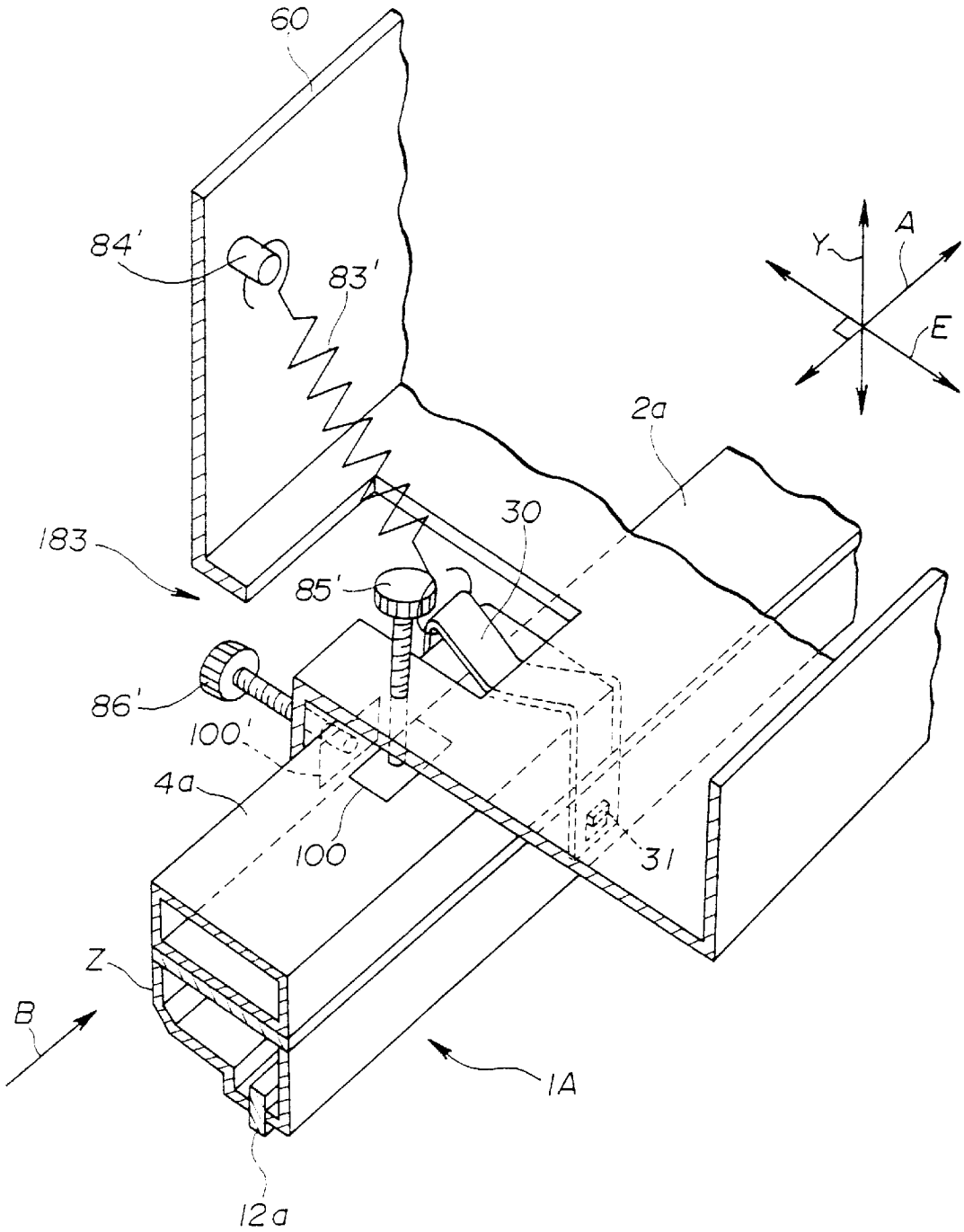
FIG. 10 is a drawing showing a third embodiment of the present invention corresponding to the third auxiliary support mechanism provided at a position IV shown in FIG. 1 and FIG. 9.

FIG. 10 shows the third embodiment of the present invention corresponding to the third auxiliary support mechanism 183 provided at the position IV shown in FIG. 1 and FIG. 9. As previously described, the light emission device array unit 1A is pulled by the spring 83', so that the adjusting screws 85' and 86' abut on sliding plates 100 and 100' stuck on the reinforcement member 4*a* of the light emission device array unit 1A.

Where the adjusting screw 85' and 86' are made of iron or stainless, the sliding plates 100 and 100' are made of stainless, having the same or greater hardness. This obviates the problem that the plateshape member is scraped.

The material of the sliding plates 100 and 100' is not limited to stainless. The type of this material will be determined in relation to the material of the adjusting screws 85' and 86'. As long as the sliding plates 100 and 100' have substantially the same hardness as the adjusting screws 85' and 86', the sliding plates can be made of any material.

The second auxiliary support mechanism 182 shown at the position III in FIG. 1 and FIG. 9 may also be configured in the same manner as the third auxiliary support mechanism 183 described above.

In the following, a fourth embodiment of the present invention will be described.

Figure 11:
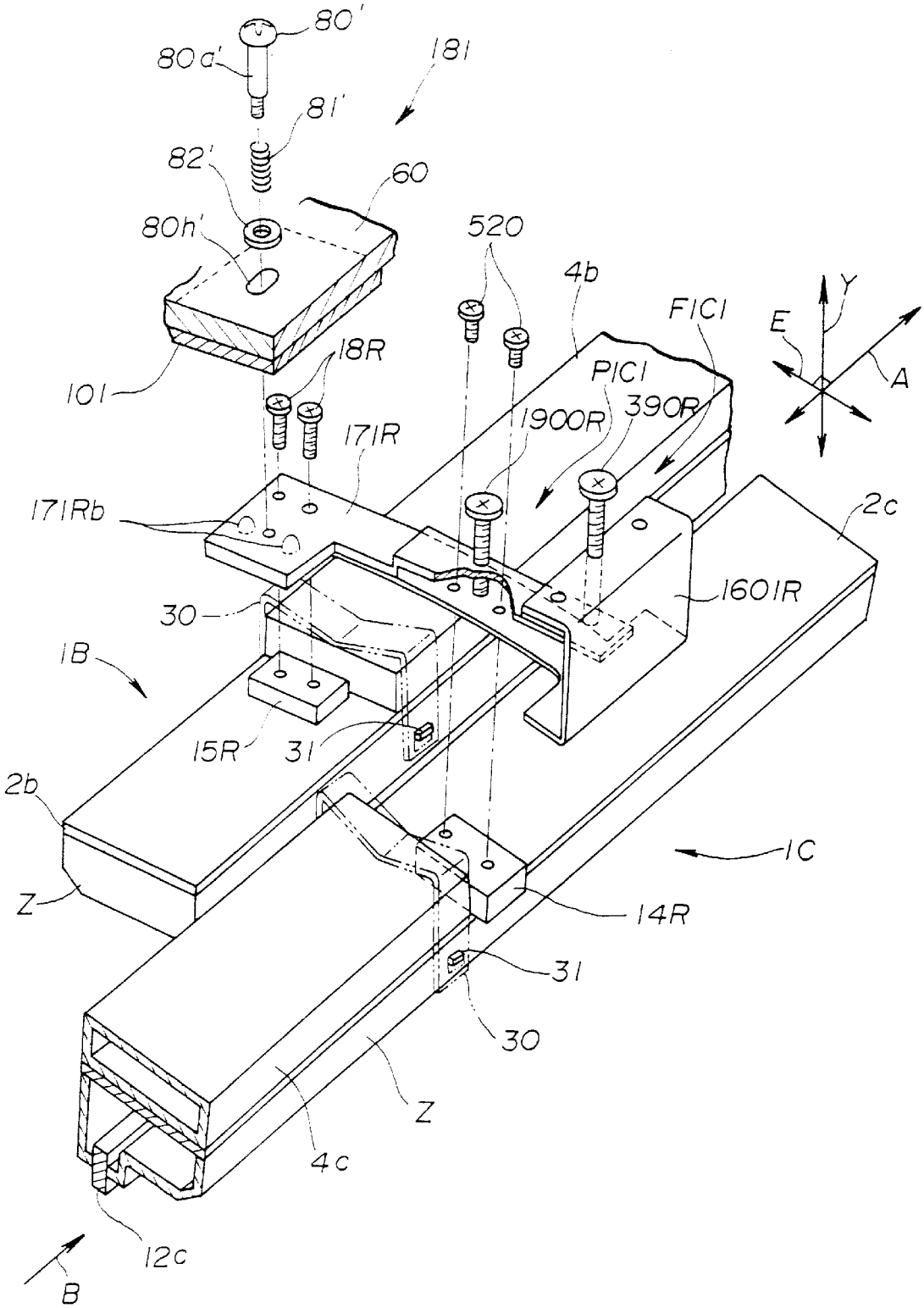
FIG. 11 is a drawing showing a first auxiliary support mechanism according to a fourth embodiment of the present invention.

FIG. 11 shows the first auxiliary support mechanism according to the fourth embodiment. The mechanism shown in FIG. 11 corresponds to the mechanism shown in FIG. 5.

The auxiliary support mechanism of the first embodiment shown in FIG. 5 has the bracket 171Ra that slides beneath the bottom surface of the frame 60 in the direction A in an event that thermal expansion or thermal contraction occurs. Since the bracket 171Ra has a flat upper surface, the contact area between the bracket 171Ra and the frame 60 is relatively large, thereby providing large friction between the bracket 171Ra and the frame 60 during the sliding movement.

In the fourth embodiment shown in FIG. 11, pin-shape members 171Rb are provided on the upper surface of the adjustment plate 171R at positions near the point into which the step screw 80' is screwed. The pin-shape members may be formed by denting the bottom surface of the adjustment plate 171R, so that the upper surface protrudes at positions where dents are made. Alternatively, the pin-shape members may be formed by making holes through the adjustment plate 171R and engaging pins in the holes, followed by securing the pins by flattening the bottom ends of the pins that stick out from the bottom surface of the adjustment plate 171R.

Further, a sliding plate 101 is provided beneath the bottom surface of the frame 60 so that the pin-shape members 171Rb abut on the sliding plate 101 when they are assembled. The sliding plate may be made of material such as iron or stainless that is as hard as the material of the pin-shape members 171Rb.

Since the contact area between the pin-shape members 171Rb and the sliding plate 101 is only the area size of the tip of the pin-shape members 171Rb, friction at the time of sliding movement is relatively small, insuring unrestricted movement in an event that thermal expansion or thermal contraction occurs. Further, since the sliding plate 101 is at least as hard as the pin-shape members 171Rb, the sliding movement of the pin-shape members 171Rb will not scrape the surface of the sliding plate 101. Unrestricted movement and stable adjustment are thus achieved.

In the following, an image forming apparatus of the present invention will be described.

Figure 12:
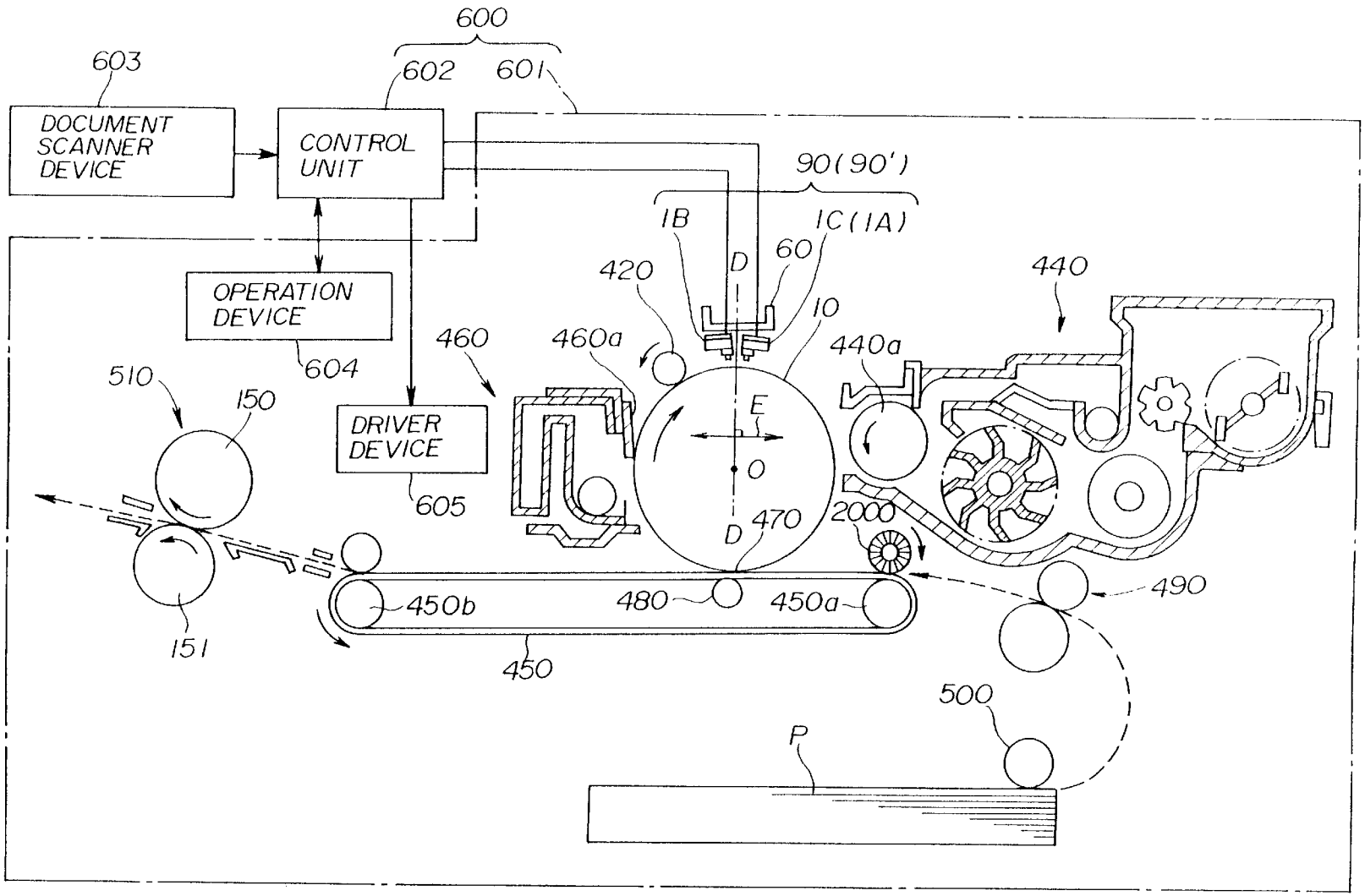
FIG. 12 is an illustrative drawing showing a configuration of an image forming apparatus according to the present invention.

FIG. 12 is an illustrative drawing showing a configuration of an image forming apparatus according to the present invention.

An image forming apparatus 600 includes an image forming unit 601 inclusive of mechanical structures for forming images and a control unit 602 inclusive of components for electrical processing, and performs a series of processes for copying stored information onto print sheets. The image forming unit 601 may include a printer unit for forming images and a document scanner unit for scanning documents and generating electrical signals representing the documents. Alternatively, the document scanner unit may be provided separately from the image forming unit, and the scanned image signals may be supplied to the control unit 602 via communication lines. In this example, a document scanner device 603 is provided separately from the image forming unit 601.

The image forming unit 601 includes the optical writing device 90 (90') and an operation device 604 serving to receive inputs such as key inputs. The image forming unit 601 further includes various components for the purpose of forming images, and these components are driven in association with each other to perform various processes. Such components include a photosensitive body 10, a developing unit 440, a transfer conveyer belt 450, which are driven by a driver device 605.

In the following, a configuration of the image forming unit 601 will be described. In FIG. 12, the photosensitive body 10 having photosensitive material on the surface thereof is surrounded by various units such as, in the clockwise order, a charging device 420 having a charging roller, the light emission device array units 1A, 1B, and 1C together forming the optical writing device 90 (90'), the developing unit 440 provided with a developing roller 440*a*, the transfer conveyer belt 450 for conveying print sheets serving as record medium P, and a cleaning device 460 inclusive of a blade 460*a* that slides on the surface of the photosensitive drum 10. The optical writing device 90 (90') emits exposure light that illuminates and scans over the photosensitive drum 10 at a position between the charging device 420 and the developing roller 440*a*. In respect of the optical writing device 90 (90'), the light emission device array units 1A, 1B, and 1C are attached to the frame 60 as described with reference to the above embodiments.

The transfer conveyer belt 450 is a loop-shape belt supported by two support rollers 450*a* and 450*b*. At a point between the support rollers 450*a* and 450*b*, the transfer conveyer belt 450 comes in contact with the surface of the photosensitive drum 10. The portion of this contact corresponds to a transfer unit 470, which includes a transfer roller 480 for applying a transfer bias on the back surface of the transfer conveyer belt 450.

The transfer conveyer belt 450 is driven to rotate in the counterclockwise direction as shown by an arrow. A pair of resist rollers 490 are provided further upstream than the transfer conveyer belt 450. The record medium P contained in a sheet feeder tray (not shown) is sent out by the feeding roller 500 toward the resist rollers 490 through conveyer guides (not shown). A fixing unit 510 including a heating roller and a pressing roller 151 is provided further downstream than the transfer conveyer belt 450.

A brush roller 200 is situated right above the support roller 450*a*, which supports the transfer conveyer belt 450 at the upstream end of the transfer conveyer belt 450. The brush roller 2000 serves as an absorbing mechanism, and is in contact with the transfer conveyer belt 450. The brush roller 2000 is driven to rotate clockwise as shown by an arrow.

As the brush roller 2000 revolves, the brush sweeps the transfer conveyer belt 450. The brush roller 2000 has a potential applied thereto from a bias applying unit (not shown) where this bias generate a bias current having such polarity as to stick the record medium P to the transfer conveyer belt 450.

In this image forming apparatus, forming of an image is performed as follows.

As the photosensitive drum 10 rotates, the charging device 420 evenly charges the photosensitive body in darkness, and the optical writing device 90 (90') shins light on the photosensitive body, thereby forming a latent image corresponding to a scanned image. This latent image is brought to the developing device 440 through the rotation of the photosensitive drum 10, and is converted into a visible toner image through application of toner.

Meanwhile, the feeding roller 500 starts feeding the record medium P from the sheet feeder tray. The record medium P travels through a path shown a by dashed curve, and temporarily stops at the position of the pair of resist rollers 490, at which it waits for proper timing of supply so that the record medium P will meet the toner image of the photosensitive drum 10 at the position of the transfer unit 470. At such proper timing, the record medium P staying at the position of the resist rollers 490 is sent out.

The record medium P sent out from the resist rollers 490 is placed between the transfer conveyer belt 450 and the brush roller 2000, and is stuck to the transfer conveyer belt 450 through the application of a static electric force created by the bias and the application of an elastic force exerted by the brush. The record medium P is carried toward the transfer unit 470 by the transfer conveyer belt 450.

The toner image of the photosensitive drum 10 and the record medium P meet each other at the position of the transfer unit 470. The toner image is then transferred onto the record medium P by an electric field generated by a difference of potential between the photosensitive body and the transfer conveyer belt 450 to which a bias is applied by the transfer roller 480.

The record medium P having the toner image thereon is conveyed by the transfer conveyer belt 450, and is released from the transfer conveyer belt 450 at the downstream end of the transfer conveyer belt 450 toward the fixing device 510. The toner image on the record medium P is fixed onto the record medium P as it passes through the fixing device 510, and the record medium P is ejected to an ejected sheet tray (not shown).

Toner remaining on the photosensitive body without being transferred by the transfer unit 470 reaches the cleaning device 460 as the photosensitive drum 10 rotates. The remaining toner is removed by the cleaning device 460, so that the photosensitive body will be ready for the next image forming process.

In the image forming apparatus according to the present invention, the optical writing device having an integral structure of light emission device array units each provided with a relatively short circuit board can form a wide image while providing an advantage in that the device size is compact compared to other optical writing devices such as laser devices. Namely, the image forming apparatus can be made compact while providing an advantage of forming a wide image.

The image forming apparatus described above may be implemented by employing any one of the embodiments previously described, and will provide advantages specific to the respective embodiments.

The optical writing device of the present invention is not limited to application to the image forming apparatus described above, and is applicable to any type of image forming apparatus such as a copier, a printer, a facsimile apparatus, a microfilm reader printer, etc., which perform optical writing for the purpose of forming images.

In the image forming apparatus, the record medium P may be stacked in the sheet feeder tray that contains a stack of paper sheets having a predetermined standard size, or may be a roll of paper sheet so that a sheet pulled out of the roll is cut into a predetermined length to provide a print sheet.

Further, the present invention is not limited to these embodiments, but various variations and modifications may be made without departing from the scope of the present invention.

The present application is based on Japanese priority application No. 2000-331845 filed on Oct. 31, 2000, with the Japanese Patent Office, the entire contents of which are hereby incorporated by reference.

What is claimed is:

1. An optical writing device, comprising:

an integral structure of a plurality of light emission device array units securely connected together, said units including respective lines of light emission devices, said lines being formed into a longer line of light emission devices on said integral structure;

a position fixing member; and a connection mechanism that fixes said integral unit to said position fixing member only at a single connection point such that displacement of said integral unit relative to said position fixing member in a direction of said longer line is prevented only at the single connection point but unrestricted at any other points, wherein the single connection point is positioned substantially at a center of an extent of said integral unit in the direction of said longer line.

2. An optical writing device, comprising:

an integral structure of a plurality of light emission device array units securely connected together, said units including respective lines of light emission devices, said lines being formed into a longer line of light emission devices on said integral structure;

a position fixing member;

a connection mechanism that fixes said integral unit to said position fixing member only at a single connection point such that displacement of said integral unit relative to said position fixing member in a direction of said longer line is prevented only at the single connection point but unrestricted at any other points; and an auxiliary support mechanism that connects said integral unit to said position fixing member at a position different from said single connection point such that displacement of said integral unit relative to said position fixing member at said position is unrestricted in said direction of said longer line, but is restricted in other directions.

3. The optical writing device as claimed in claim 2, wherein said auxiliary support mechanism includes a plate-shape member and a pin-shape member that abuts on said plate-shape member, said displacement of said integral unit relative to said position fixing member at said position is made by said pin-shape member sliding on said plate-shape member.

4. The optical writing device as claimed in claim 3, said plate-shape member has hardness substantially as high as or higher than that of said pin-shape member.

5. An optical writing device, comprising:

an integral structure of a plurality of light emission device array units securely connected together, said units including respective lines of light emission devices, said lines being formed into a longer line of light emission devices on said integral structure;

a position fixing member; and means for fixing a position of said integral unit relative to said position fixing member in a direction of said longer line while allowing unrestricted expansion and contraction of said integral unit in the direction of said longer line, wherein a point at which said integral unit is fixedly positioned relative to said position fixing member is substantially at a center of an extent of said integral unit in the direction of said longer line.

6. An optical writing device, comprising:

an integral structure of a plurality of light emission device array units securely connected together, said units including respective lines of light emission devices, said lines being formed into a longer line of light emission devices on said integral structure;

a position fixing member;

means for fixing a position of said integral unit relative to said position fixing member in a direction of said longer line while allowing unrestricted expansion and contraction of said integral unit in the direction of said longer line; and auxiliary support means for providing said integral unit with additional support by said position fixing member without restricting the expansion and contraction of said integral unit in the direction of said longer line.

7. The optical writing device as claimed in claim 6, wherein said auxiliary support means includes a plate-shape member and a pin-shape member that abuts on said plate-shape member, said pin-shape member sliding on said plate-shape member in response to the expansion and contraction of said integral unit in the direction of said longer line.

8. The optical writing device as claimed in claim 7, said plate-shape member has hardness substantially as high as or higher than that of said pin-shape member.

9. An apparatus for forming an image, comprising:

a photosensitive body;

an optical writing device which forms a latent image on said photosensitive body by scanning light on said photosensitive body;

a developing unit which converts the latent image into a visible image, said optical writing device including, an integral structure of a plurality of light emission device array units securely connected together, said units including respective lines of light emission devices, said lines being formed into a longer line of light emission devices on said integral structure, a position fixing member, and a connection mechanism that fixes said integral unit to said position fixing member only at a single connection point such that displacement of said integral unit relative to said position fixing member in a direction of said longer line is prevented only at the single connection point but unrestricted at any other points, wherein the single connection point is positioned substantially at a center of an extent of said integral unit in the direction of said longer line.

10. An apparatus for forming an image, comprising:

a photosensitive body;

an optical writing device which forms a latent image on said photosensitive body by scanning light on said photosensitive body;

a developing unit which converts the latent image into a visible image, said optical writing device including, an integral structure of a plurality of light emission device array units securely connected together, said units including respective lines of light emission devices, said lines being formed into a longer line of light emission devices on said integral structure, a position fixing member, and a connection mechanism that fixes said integral unit to said position fixing member only at a single connection point such that displacement of said integral unit relative to said position fixing member in a direction of said longer line is prevented only at the single connection point but unrestricted at any other points; and an auxiliary support mechanism that connects said integral unit to said position fixing member at a position different from said single connection point such that displacement of said integral unit relative to said position fixing member at said position is unrestricted in said direction of said longer line, but is restricted in other directions.

11. The apparatus as claimed in claim 10, wherein said auxiliary support mechanism includes a plate-shape member and a pin-shape member that abuts on said plate-shape member, said displacement of said integral unit relative to said position fixing member at said position is made by said pin-shape member sliding on said plate-shape member.

12. The apparatus as claimed in claim 11, said plate-shape member has hardness substantially as high as or higher than that of said pin-shape member.

13. An apparatus for forming an image, comprising:

a photosensitive body;

an optical writing device which forms a latent image on said photosensitive body by scanning light on said photosensitive body; and a developing unit which converts the latent image into a visible image, wherein said optical writing device including, an integral structure of a plurality of light emission device array units securely connected together, said units including respective lines of light emission devices, said lines being formed into a longer line of light emission devices on said integral structure, a position fixing member, and means for fixing a position of said integral unit relative to said position fixing member in a direction of said longer line while allowing unrestricted expansion and contraction of said integral unit in the direction of said longer line, wherein a point at which said integral unit is fixedly positioned relative to said position fixing member is substantially at a center of an extent of said integral unit in the direction of said longer line.

14. An apparatus for forming an image, comprising:

a photosensitive body;

an optical writing device which forms a latent image on said photosensitive body by scanning light on said photosensitive body;

a developing unit which converts the latent image into a visible image, wherein said optical writing device including, an integral structure of a plurality of light emission device array units securely connected together, said units including respective lines of light emission devices, said lines being formed into a longer line of light emission devices on said integral structure, a position fixing member, and means for fixing a position of said integral unit relative to said position fixing member in a direction of said longer line while allowing unrestricted expansion and contraction of said integral unit in the direction of said longer line; and auxiliary support means for providing said integral unit with additional support by said position fixing member without restricting the expansion and contraction of said integral unit in the direction of said longer line.

15. The apparatus as claimed in claim 14, wherein said auxiliary support means includes a plate-shape member and a pin-shape member that abuts on said plate-shape member, said pin-shape member sliding on said plate-shape member in response to the expansion and contraction of said integral unit in the direction of said longer line.

16. The apparatus as claimed in claim 15, said plate-shape member has hardness substantially as high as or higher than that of said pin-shape member.

* * * * *